United States Patent [19]

Kobayashi et al.

[11] Patent Number: 5,036,758

[45] Date of Patent: Aug. 6, 1991

[54] EMBOSS ROLL

[75] Inventors: Yoshinori Kobayashi; Naoyuki Tamura, both of Yamaguchi, Japan

[73] Assignee: Mitsui Petrochemical Industries, Ltd., Tokyo, Japan

[21] Appl. No.: 306,670

[22] Filed: Feb. 6, 1989

[30] Foreign Application Priority Data

Sep. 21, 1987 [JP] Japan ..... 62-144269

[51] Int. Cl.[5] ..... B31F 1/07

[52] U.S. Cl. ..... 101/28; 29/121.1; D18/22

[58] Field of Search ..... 101/16, 28, 29, 30, 101/398, 399; 29/121.1, 121.2; 400/466; 156/219, 220; D18/13, 15, 19, 22

[56] References Cited

U.S. PATENT DOCUMENTS

| | | | |
|---|---|---|---|
| 1,732,223 | 10/1929 | Conard | 101/30 X |
| 3,214,309 | 10/1965 | Di Leo et al. | 101/28 X |
| 3,244,094 | 4/1966 | Gresham | 101/28 |
| 4,630,537 | 12/1986 | Pretorius | 101/28 X |

FOREIGN PATENT DOCUMENTS

| | | | |
|---|---|---|---|
| 179650 | 10/1983 | Japan | 400/466 |
| 204615 | 10/1923 | United Kingdom | 101/28 |

*Primary Examiner*—Edgar S. Burr
*Assistant Examiner*—Moshe I. Cohen
*Attorney, Agent, or Firm*—Birch, Stewart, Kolasch & Birch

[57] ABSTRACT

An emboss roll according to the present invention is capable of assuredly performing an embossing work without any risk of shaving a surface of nonwoven fabrics and forming pin holes when used to emboss nonwoven fabrics for the purpose of prevention of filament shavings to be adhered to products. This emboss roll having an outer surface thereof provided with embossing projections wherein all of the top end corners thereof are cut so as to be a surface. As a result of cutting the top end corners of the embossing projections, nonwoven fabrics can be protected from being cut by the corner portions or forming pin holes during the embossing work.

3 Claims, 1 Drawing Sheet

EMBOSS ROLL

BACKGROUND OF THE INVENTION

1. Field of the Invention

The present invention relates to an emboss roll for embossing nonwoven fabrics or the like.

2. Discussion of Related Art

Hitherto, in order to emboss nonwoven fabrics or the like, the nonwoven fabric is sandwiched by an emboss roll so that the emboss pattern carved on the surface of the emboss roll is transferred.

However, since the conventional emboss roll is provided with the projections for forming embossment in the form of, as shown in FIG. 4, a sharp edge 2, these edges 2 of the projections 1 can shave the surface of the nonwoven fabric. As a result, filament shavings adhere to the emboss roll at which the shavings gradually grow. Therefore, performing of embossing work at the subject portion can be prevented. In addition, the adhered shavings finally adhere to the product, causing for the appearance of the product to deteriorate. In the worst case, pin holes can be formed in the nonwoven fabric.

SUMMARY OF THE INVENTION

An object of the present invention is to provide an emboss roll capable of assuredly embossing nonwoven fabrics without any shavings at the surface of the nonwoven fabrics, forming any pin holes, and adhesion of filament shavings to the product.

An emboss roll according to the present invention and having embossing projections on the outer surface thereof, characterized by that: top end corners of said embossing projection portion are cut so as to be a surface.

As a result of cutting the top end corners of the embossing projection, nonwoven fabrics can be protected from being shaved by the corner portions or forming pin holes during the embossing work.

DESCRIPTION OF THE PREFERRED EMBODIMENTS

Figure 1:
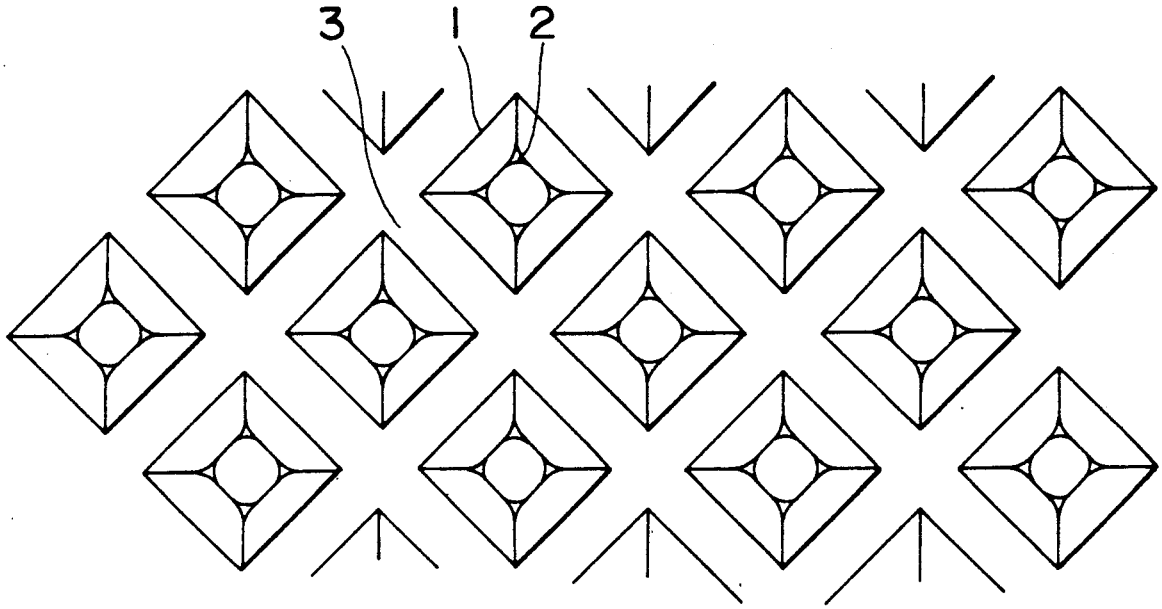
FIG. 1 is a plan view of embossing projections according to an embodiment of the present invention.
Figure 2:
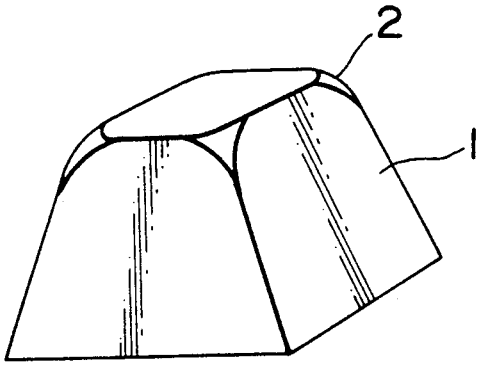
FIG. 2 is a perspective view of a embossing projection.
Figure 3:
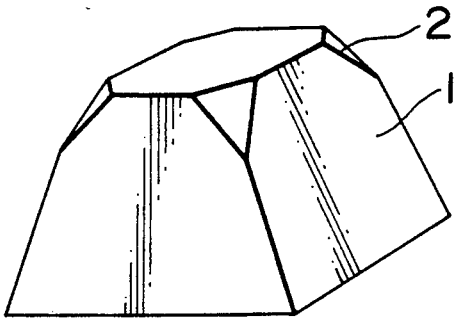
FIG. 3 is a perspective view of the same according to another embodiment.
Figure 4:
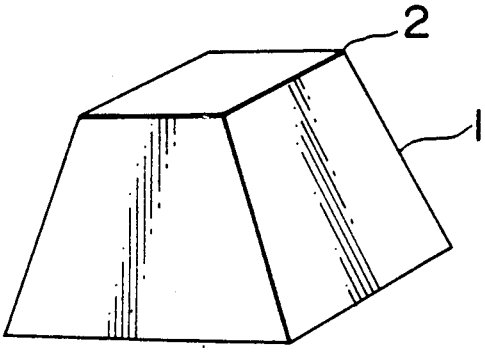
FIG.4 PRIOR ART
FIG. 4 is a perspective view according to a conventional example.

An emboss roll according to the present invention and having embossing projections 1 on the outer surface thereof, characterized by that: top end corners 2 of said embossing projections 1 are cut so as to be a surface, wherein the description "top end corners 2 are cut so as to be surfaces" can be exemplified by that: each of the corners 2 is, as shown in FIGS. 1 and 2, made a curved surface by performing a so-called rounding work; or each of the corners 2 is, as shown in FIG. 3, made a flat surface by performing a so-called chamfering. In the present invention, the embossing projection may be freely designed only satisfying a factor that corners are provided at the top end portion, for instance, truncated pyramid, circular truncated corn and so on.

An embodiment of the present invention will now be described with reference to the accompanying drawings.

First Embodiment and First Comparative Embodiment

As shown in FIG. 1, embossing projections 1 are formed by arranging inclined grooves 3 each of which is inclined by 45° with respect to the circumferential direction of an emboss roll on the outer surface of the emboss roll. The thus-arranged of each embossing projection 1 is also arranged to be in the form of a quadrangular truncated pyramid having an inclined side surface thereof and a level upper surface. The four top end corners 2 of each embossing projection 1 are cut due to the rounding work so that the shape of each of the four top end corners 2 are formed in a curved surface as shown in FIG. 2.

Specifically, in this embodiment, the width of each of the grooves 3 was arranged to be 0.4 mm, while one of the embossing projection 1 was arranged to be: height 0.5 mm; length of one side of the bottom surface 0.8 mm; and length of one side of the upper surface 0.5 mm. The curved surface was formed by performing a rounding work to the top end corner 2. The radius of the curved surface was 0.01 mm.

A test was conducted in such a manner that an emboss roll having embossing projections subjected to the chamfering work and an emboss roll having embossing projections which have been the same size as first embodiment but have not been subjected to the rounding work were used to emboss a polypropylene nonwoven fabric manufactured by a spunbond method. Then, the amount of the filaments cut by embossing projections of the each emboss roll was measured, resulting as shown in Table 1.

The weight per area of this nonwoven fabric was 25 $g/m^2$, and the line speed for the nonwoven fabric was 60 m/minute.

Second Embodiment and Second Comparative Embodiment

An emboss roll comprising, similarly to First embodiment, quadrangular truncated pyramid embossing projections 1 is used, in which the width of the groove 3 to form the projection 1 was substantially 0.58 mm. One of the embossing projections 1 was arranged: height 0.5 mm; length of one side of the bottom surface 0.92 mm; and length of one side of the upper surface 0.34 mm. The top end corner 2 of each of this projection is provided with the chamfering work C=0.01 mm. In addition, an emboss roll having embossing projections which have been the same size as the ones of second embodiments but have not been subjected to any chamfering work is used. A polypropylene nonwoven fabric was embossed so as to measure the amount of the cut filaments. The results are shown in Table 1. Other experimental conditions are the same as those for First Embodiment.

TABLE 1

| | Amount of filaments adhered to emboss roll after the nonwoven fabric has been subjected to the embossing work for 24 hours | Softness (g) | |
|---|---|---|---|
| | | Vertical | Lateral |
| First Embodiment | substantially zero | 5.8 | 1.8 |
| First Comparative Embodiment | 250 | 6.2 | 2.1 |
| Second Embodiment | substantially zero | 5.5 | 1.8 |
| Second Comparative Embodiment | 200 | 6.0 | 2.0 |

The vertical and lateral softness was measured by a handleometer method.

According to the present invention, the amount of the shavings cut by the corner portion at the time of embossing work can be significantly reduced. As a result, the risk of prevention of the embossing work since the projection is covered by the shavings and the risk of manufacturing defective products due to the adhesion of the shavings can be significantly reduced. Furthermore, no pin hole can be formed, and the softness can be improved.

In addition, the necessity to remove the shavings which can be adhered to the surface of emboss rolls becomes needless. Consequently, an easy maintenance can be performed.

What is claimed is:

1. An embossing roll for embossing nonwoven fabrics and having embossing projections on the outer surface thereof, each of said embossing projections being a frustum of a pyramid having a flat top with four corners, each of said four corners being cut to form a generally triangular surface, having a base in the plane of said top surface with the remaining two sides of said triangular surface meeting below but near said top flat surface.

2. The embossing roll of claim 1 wherein each of said generally triangular surfaces is flat.

3. The embossing roll of claim 1 wherein each of said generally triangular surfaces is rounded.

* * * * *